US009016518B2

(12) United States Patent
Poul et al.

(10) Patent No.: US 9,016,518 B2
(45) Date of Patent: Apr. 28, 2015

(54) BEVERAGE DISPENSING FLOW CONTROL DEVICE AND METHOD THEREOF

(71) Applicant: Service Ideas, Inc., Woodbury, MN (US)

(72) Inventors: Gregory D. Poul, St. Paul, MN (US); Daniel Hsi Ping Chu, Lexington, MA (US); Joseph Krawczyk, Hugo, MN (US)

(73) Assignee: Service Ideas, Inc., Woodbury, MN (US)

( * ) Notice: Subject to any disclaimer, the term of this patent is extended or adjusted under 35 U.S.C. 154(b) by 95 days.

(21) Appl. No.: 13/782,505

(22) Filed: Mar. 1, 2013

(65) Prior Publication Data

US 2014/0246463 A1 Sep. 4, 2014

(51) Int. Cl.
*B67D 7/22* (2010.01)
*A47G 19/14* (2006.01)

(52) U.S. Cl.
CPC ..... *A47G 19/14* (2013.01)

(58) Field of Classification Search
CPC ..... A47G 19/00; B67D 3/00; B65D 47/00
USPC ..... 222/23, 29, 31, 163, 472–474, 222/475–475.1, 481–489, 502–503, 222/531–532, 323–324, 519–525, 222/145.7–145.8, 564, 547, 1, 542
See application file for complete search history.

(56) References Cited

U.S. PATENT DOCUMENTS

| | | | | |
|---|---|---|---|---|
| 2,592,279 | A * | 4/1952 | Heier | 222/42 |
| 3,586,246 | A * | 6/1971 | Van Der Lely et al. | 239/665 |
| 4,643,881 | A * | 2/1987 | Alexander et al. | 422/265 |
| 4,991,781 | A * | 2/1991 | Barbieri | 239/661 |
| D364,990 | S | 12/1995 | Fonville | |
| D386,934 | S | 12/1997 | Huang | |
| 5,746,356 | A * | 5/1998 | Kieras | 222/212 |
| D394,981 | S | 6/1998 | Huang | |
| 5,855,300 | A * | 1/1999 | Malki | 222/153.09 |
| 5,901,886 | A * | 5/1999 | Grindstaff et al. | 222/557 |
| D420,545 | S | 2/2000 | Huang | |
| D454,468 | S | 3/2002 | Mano | |
| 6,427,880 | B1 * | 8/2002 | Hirose et al. | 222/517 |
| 6,648,183 | B2 * | 11/2003 | Nybakke | 222/472 |
| D521,795 | S | 5/2006 | Imai | |
| D528,846 | S | 9/2006 | Tamura | |
| D562,053 | S | 2/2008 | Cohen | |
| D587,957 | S | 3/2009 | Imai | |
| D611,754 | S | 3/2010 | Bodum | |

(Continued)

*Primary Examiner* — Paul R Durand
*Assistant Examiner* — Andrew P Bainbridge
(74) *Attorney, Agent, or Firm* — Skaar Ulbrich Macari, P.A.

(57) ABSTRACT

A beverage dispensing flow control device according to one example includes a body portion, an actuation lever and a sealing gasket. A sealing gasket is securable over the bottom surface of the body and has a bottom surface with a beverage flow aperture and a vent aperture. The apertures are configured to define a maximum flow position when the sealing gasket is rotationally aligned with respect to the body portion such that the beverage flow aperture does not block the flow aperture of the body portion, and a minimum flow position when the sealing gasket is rotationally aligned with respect to the body portion such that the beverage flow aperture blocks at least the majority of the body's flow aperture while leaving at least a portion of the vent channel unblocked. A plunger is in operable communication with the actuation lever to selectively seal the bottom surface of the gasket.

17 Claims, 15 Drawing Sheets

(56) References Cited

U.S. PATENT DOCUMENTS

| | | | | |
|---|---|---|---|---|
| D638,651 | S | 5/2011 | Butler | |
| D669,307 | S | 10/2012 | Makhanlall et al. | |
| 8,376,250 | B2 * | 2/2013 | Conner et al. | 239/666 |
| D686,864 | S | 7/2013 | Poul et al. | |
| 2007/0012698 | A1 * | 1/2007 | Durdon et al. | 220/253 |
| 2009/0277979 | A1 * | 11/2009 | Cichy et al. | 239/683 |

* cited by examiner

BEVERAGE DISPENSING FLOW CONTROL DEVICE AND METHOD THEREOF

FIELD

The present invention relates generally to beverage containers and, more particularly, to a flow control device for controlling the flow of liquid being dispensed from a container.

BACKGROUND

Beverage dispensers, such as coffee pots, are frequently employed in food service operations, such as at restaurants, to allow servers and customers to dispense a selected volume of beverage into a cup so that the beverage can be consumed. Typical beverage dispensers such as that disclosed in U.S. Pat. No. 6,648,183, which is hereby incorporated by reference in its entirety, generally comprise a receptacle or container portion that holds the beverage and a stopper or lid device that seals the container. The lid can be selectively opened by the user for dispensing by pressing a lever. The container can be insulated or can be configured as a vacuum pot so that the temperature of the beverage in the container can be maintained.

Drawbacks to typical conventional containers include leakage, difficulty to open/close flow, inability or difficulty in adjusting the flow rate, complexity, reliability, cost, and ease of cleaning. Therefore, there is a need for a beverage container that addresses some or all of these noted deficiencies of the conventional dispensers.

SUMMARY

The present invention addresses certain deficiencies in the prior art by providing for a device, method and system of selectably dispensing beverages from a container. The dispenser in certain embodiments includes a lid assembly comprising a sealing gasket disposable on a lid assembly and configured to seal against a stopper and to seal the perimeter of the lid assembly so that liquid does not flow out of the container when the dispensing plunger is not engaged. The sealing gasket further defines an aperture that can be selectively aligned with respect to the lid assembly to set a flow rate. This arrangement provides for a reliable seal and smooth steady pouring. The lid assembly can also be configured for quarter turn engagement and disengagement with an opening defined in the top of the container.

The lid assembly can be used with a variety of container shapes and types, and with a variety of food products, including coffee, tea, water, soda, milk, juice, mixed beverages and other non-viscous liquids and flowable substances.

A beverage dispensing flow control device according to one example includes a body portion, an actuation lever and a sealing gasket. A sealing gasket is securable over the bottom surface of the body and has a bottom surface with a beverage flow aperture and a vent aperture. The apertures are configured to define a maximum flow position when the sealing gasket is rotationally aligned with respect to the body portion such that the beverage flow aperture does not block the flow aperture of the body portion, and a minimum flow position when the sealing gasket is rotationally aligned with respect to the body portion such that the beverage flow aperture blocks at least the majority of the body's flow aperture while leaving at least a portion of the vent channel unblocked. A plunger is in operable communication with the actuation lever to selectively seal the bottom surface of the gasket.

A method of dispensing beverages from a beverage dispenser according to certain embodiments includes disposing a sealing gasket on a lower portion of a lid assembly body while rotationally aligning an indicator on the gasket with a flow rate marking on the lid assembly body, the alignment step blocking none of a beverage dispensing passage in the lid assembly body with a gasket bottom surface in a maximum flow state and the alignment step blocking a majority of a beverage dispensing passage in the lid assembly body with the gasket bottom surface in a minimum flow state.

The above summary is not intended to limit the scope of the invention, or describe each embodiment, aspect, implementation, feature or advantage of the invention. The detailed technology and preferred embodiments for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

Figure 1:
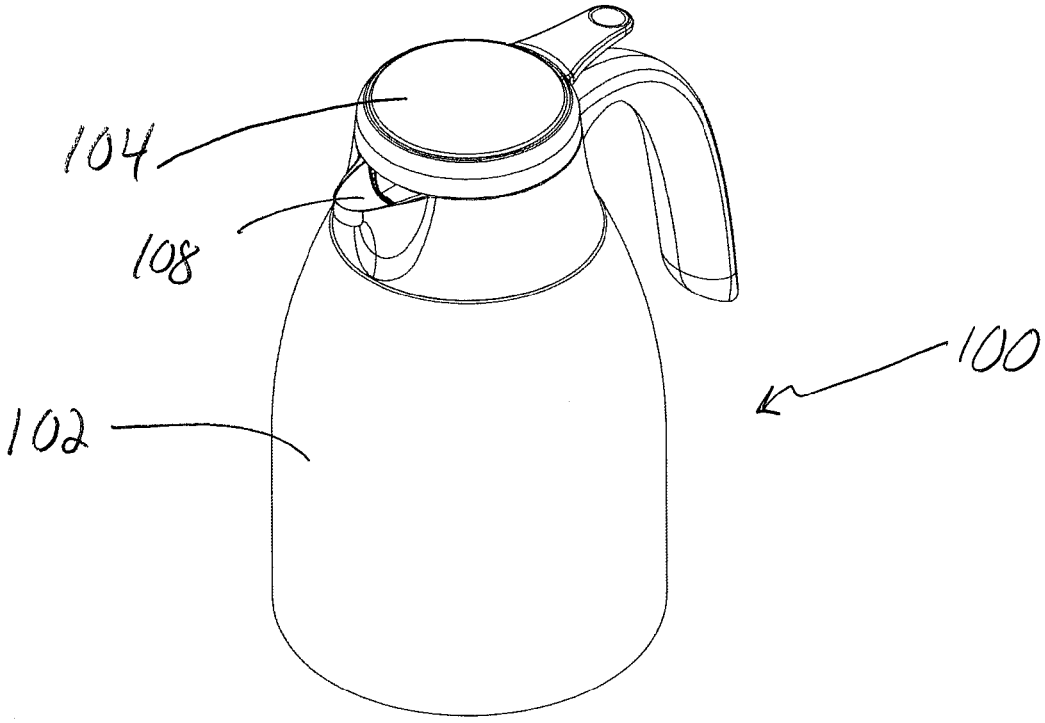
FIG. 1 is a perspective view of a beverage dispenser according to certain example embodiments.

While the invention is amenable to various modifications and alternative forms, specifics thereof have been shown by way of example in the drawings and will be described in detail. It should be understood, however, that the intention is not to limit the invention to the particular example embodiments described. On the contrary, the invention is to cover all combinations, modifications, equivalents, and alternatives falling within the scope of the invention as defined by the appended claims.

DETAILED DESCRIPTION

In the following descriptions, the present invention will be explained with reference to various example embodiments; nevertheless, these embodiments are not intended to limit the present invention to any specific example, environment, application, or particular implementation described herein. Therefore, descriptions of these example embodiments are only provided for purpose of illustration rather than to limit the present invention.

Figure 2:
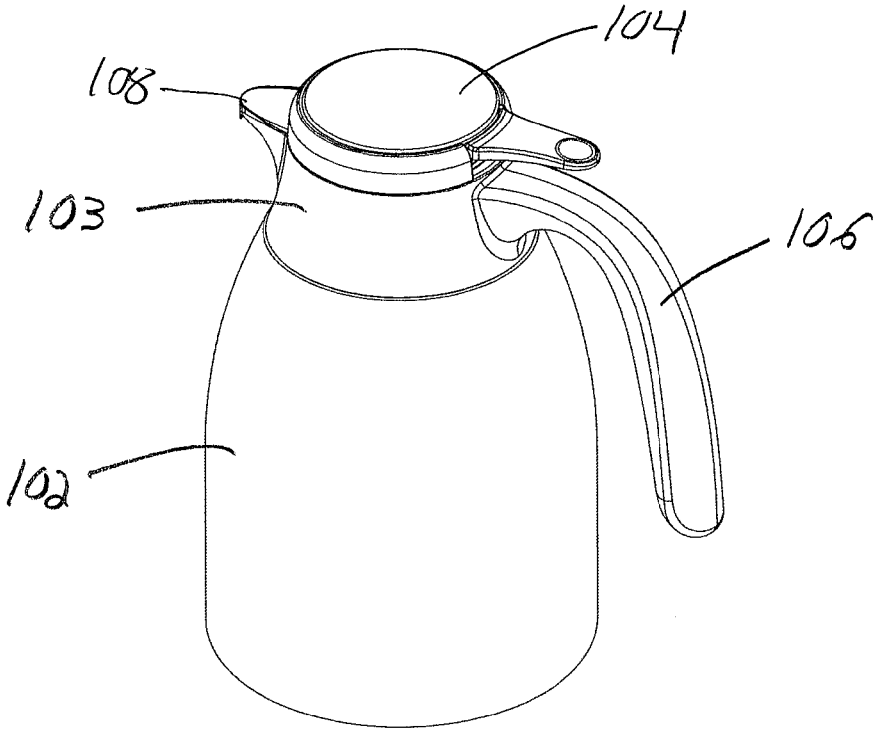
FIG. 2 is another perspective view of a beverage dispenser according to certain example embodiments.
Figure 3:
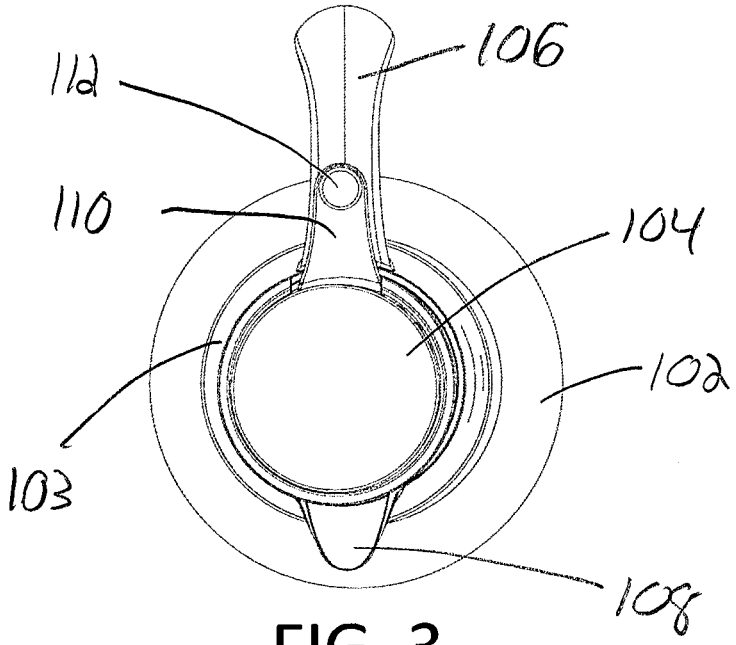
FIG. 3 is a top view of a beverage dispenser according to certain example embodiments.

Referring to FIGS. 1-3, various external views of a beverage dispenser 100 are shown. The dispenser depicted is configured as a coffee pot (also referred to a server and a vessel), however, the dispenser may be configured in many different ways without departing from the scope of the invention. The dispenser 100 generally comprises a receptacle or container body 102 having a hollow interior and a lid assembly 104.

The dispenser body includes a neck region 103 with an opening in the top to access the interior. A handle 106 extends from the neck and is configured to allow a person to easily grasp the dispenser with one hand and tip the dispenser to pour. Alternatively, the handle 106 can be attached to another portion of the body 102 to accomplish the same purpose.

The neck region further includes an outwardly extending pouring spout 108. The pouring spout 108 is configured to shape the liquid exiting the dispenser to that the user can achieve a controlled pour. In particular, the contour of the spout contains the horizontal spread of the liquid during a pour so that the liquid can be controllably introduced to the user's cup or other chosen receptacle.

The lid assembly 104 is securable in the opening of the container to close off the interior of the dispenser so that beverage contained therein does not spill out and contaminants do not enter. The lid assembly includes an actuator lever 110. The lid assembly is configured to be closed to flow when in the steady-state condition (i.e., non-actuated). The user can depress the lever 110 to move the lid assembly into the open or pouring state so that liquid can be dispensed from the dispenser 100. In one embodiment, the lever 110 extends rearwardly and above the handle so that the user's thumb can press downwardly on the lever to open the dispenser and pour the liquid contents into a receptacle. A thumb rest 112 can be provided to or defined in a portion of the lever to facilitate thumb traction and placement on the lever for reliable pouring.

Figure 4:
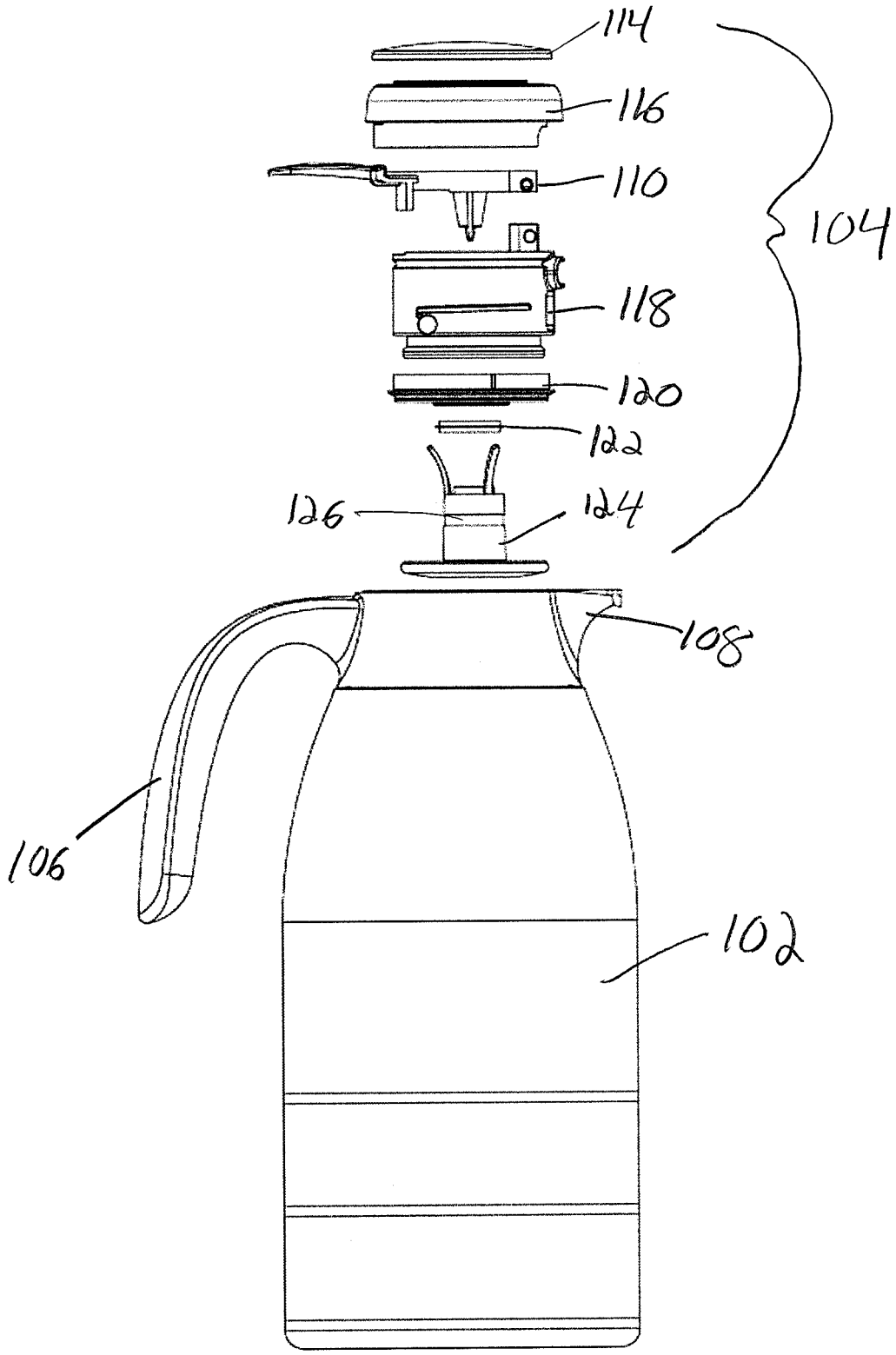
FIG. 4 is an exploded side view a beverage dispenser according to certain example embodiments.
Figure 5:
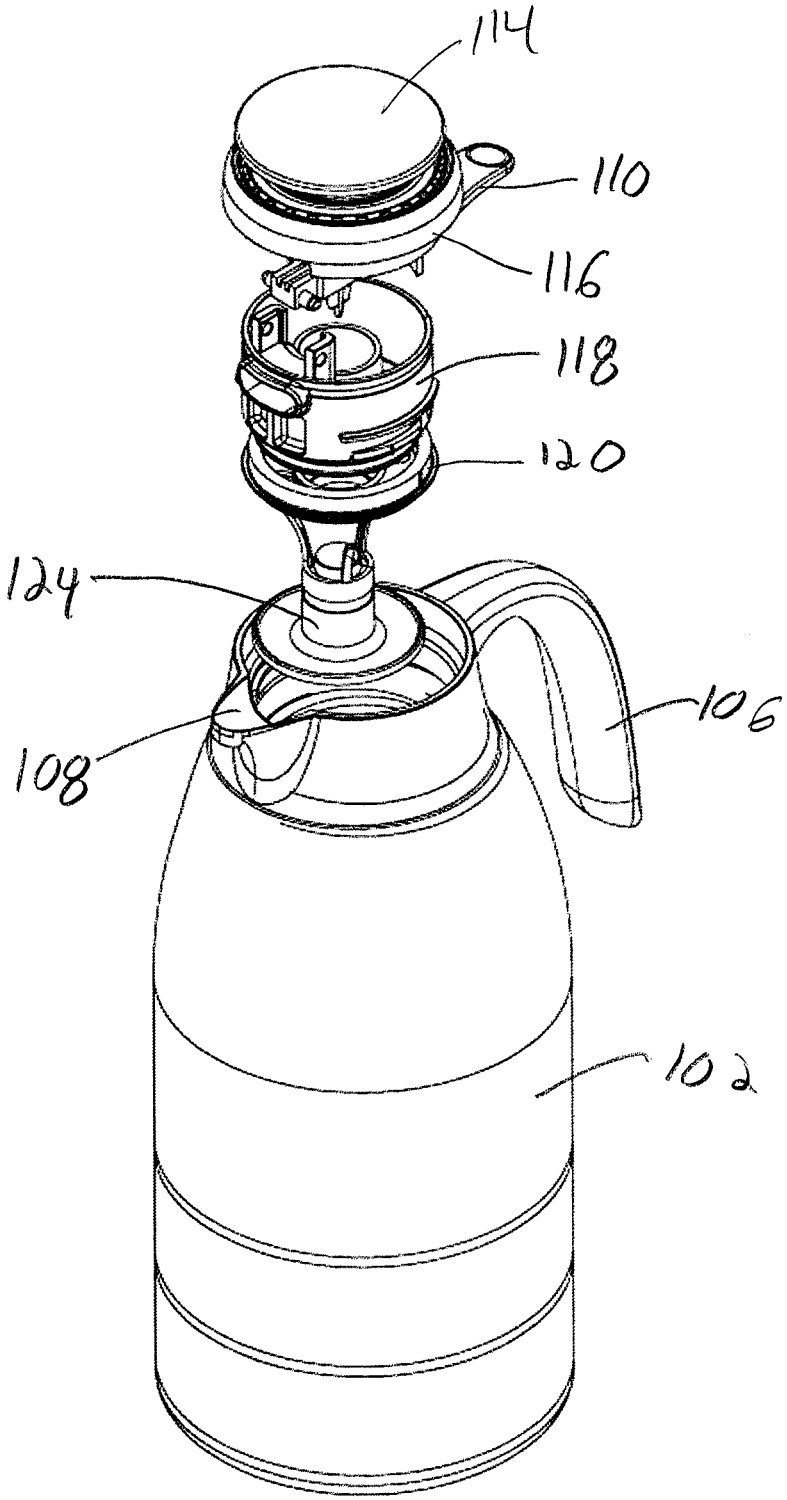
FIG. 5 is an exploded perspective view a beverage dispenser according to certain example embodiments.

Referring now to FIGS. 4-5, the various components of a dispenser and dispensing assembly can be seen in various views according to certain embodiments of the invention. Note that the container body 102 is shown in a different configuration compared to the previous embodiment in order to illustrate that the invention can be embodied in containers of many different sizes and shapes.

The lid assembly 104 comprises a lid cap 114, an upper body portion 116, the lever 110, a lower body portion 118, a sealing gasket 120, a circular seal ring 122 and a plunger 124. The cap 114 is disposed on the top of the upper portion 116 to seal the internals of the lid assembly. However, the cap can alternatively be formed unitarily as the upper surface of the upper portion 116. The lever 110 is disposed between the upper portion 116 and the lower portion 118. The gasket 120 fits around a lower portion of the lower body 118 and also extends across the bottom surface thereof except for a flow aperture that the be discussed later herein. The seal ring 122 is disposed in a respective groove 126 defined in the sidewall of the plunger 124. The plunger is inserted upward into the assembled upper/lower portions until its bottom surface contacts the gasket, thereby forming a seal to prevent the flow of liquid contends unless the lever is depressed to retract the plunger away from the gasket.

Figure 6:
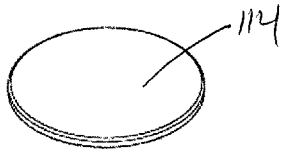
FIG. 6 is a perspective view of a cap of a flow control device according to certain example embodiments.
Figure 7:
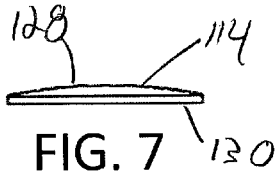
FIG. 7 is a side view of a cap of a flow control device according to certain example embodiments.
Figure 8:
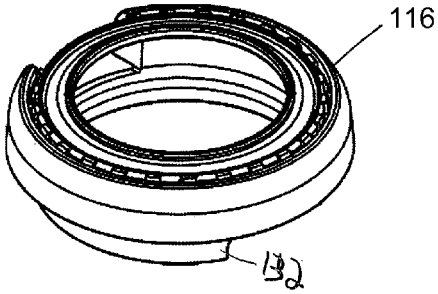
FIG. 8 is a perspective view of a lid body upper portion of a flow control device according to certain example embodiments.
Figure 9:
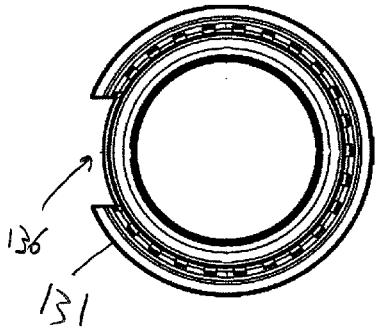
FIG. 9 is a top view of a lid body upper portion of a flow control device according to certain example embodiments.
Figure 10:
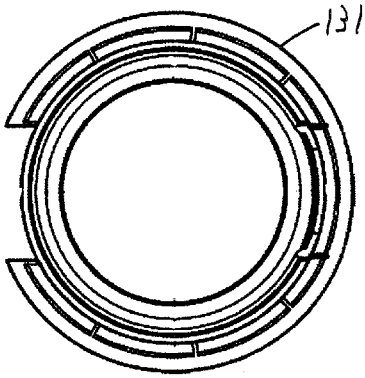
FIG. 10 is a bottom view of a lid body upper portion of a flow control device according to certain example embodiments.
Figure 11:
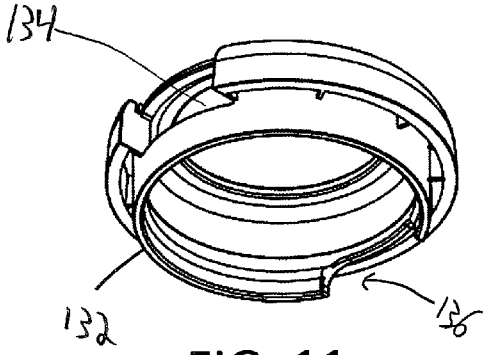
FIG. 11 is a perspective view of a lid body upper portion of a flow control device according to certain example embodiments.
Figure 12:
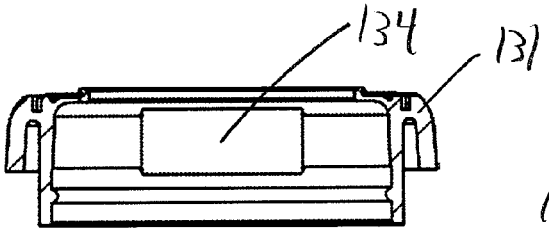
FIG. 12 is a side cross sectional view along the line indicated in FIG. 13.
Figure 13:
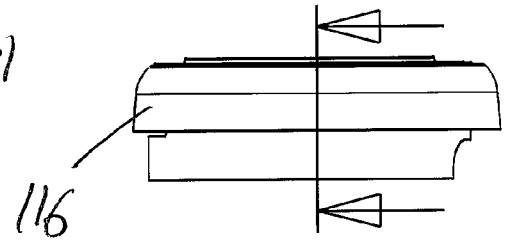
FIG. 13 is a side view of a lid body upper portion of a flow control device according to certain example embodiments.
Figure 14:
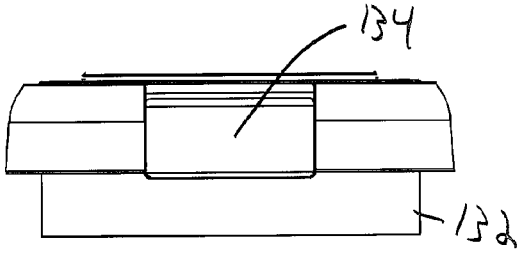
FIG. 14 is a side view of a lid body upper portion of a flow control device according to certain example embodiments.
Figure 15:
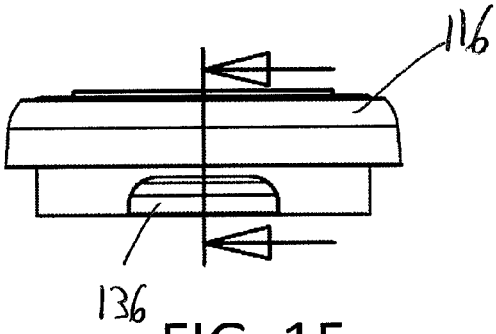
FIG. 15 is a side cross sectional view along the line indicated in FIG. 16.
Figure 16:
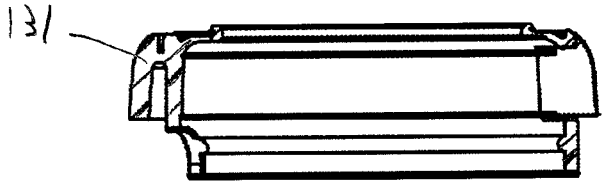
FIG. 16 is a side view of a lid body upper portion of a flow control device according to certain example embodiments.
Figure 17:
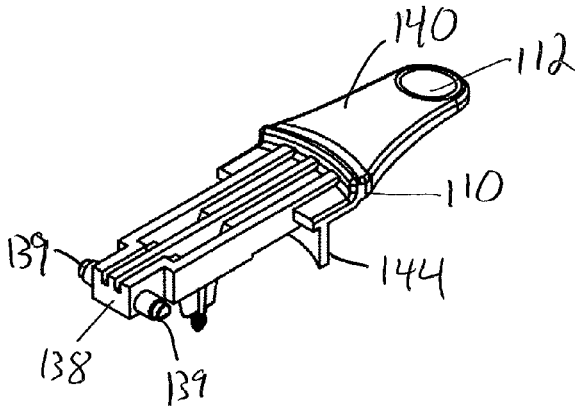
FIG. 17 is a perspective view of an actuation lever of a flow control device according to certain example embodiments.
Figure 18:
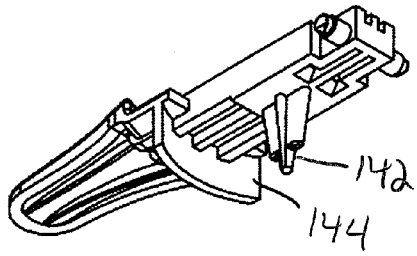
FIG. 18 is a perspective view of an actuation lever of a flow control device according to certain example embodiments.
Figure 19:
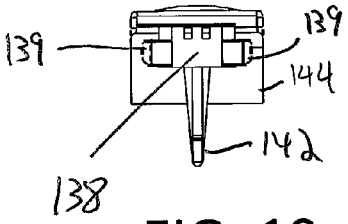
FIG. 19 is an end view of an actuation lever of a flow control device according to certain example embodiments.
Figure 20:
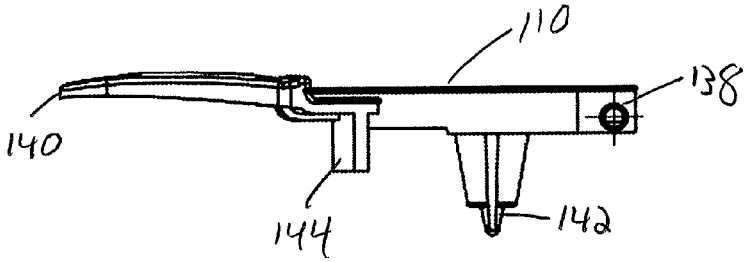
FIG. 20 is a side view of an actuation lever of a flow control device according to certain example embodiments.
Figure 21:
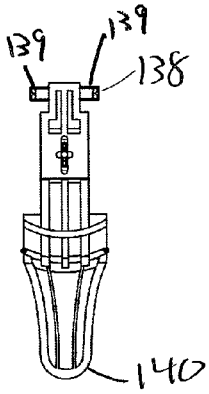
FIG. 21 is a bottom view of an actuation lever of a flow control device according to certain example embodiments.
Figure 22:
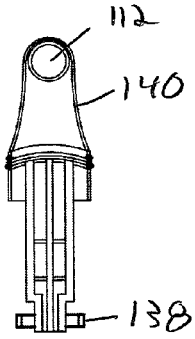
FIG. 22 is a top view of an actuation lever of a flow control device according to certain example embodiments.
Figure 23:
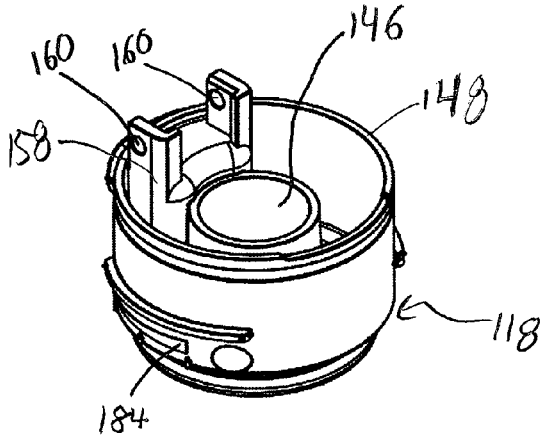
FIG. 23 is a perspective view of a lid body lower portion of a flow control device according to certain example embodiments.
Figure 24:
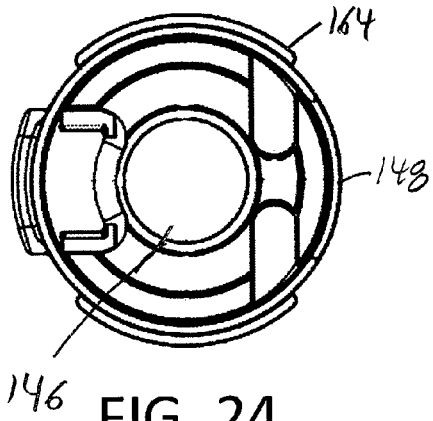
FIG. 24 is a top view of a lid body lower portion of a flow control device according to certain example embodiments.
Figure 25:
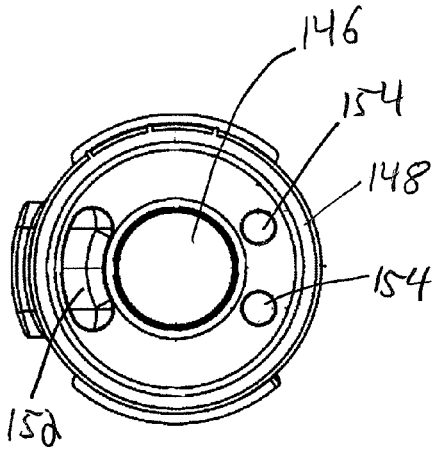
FIG. 25 is a bottom view of a lid body lower portion of a flow control device according to certain example embodiments.
Figure 26:
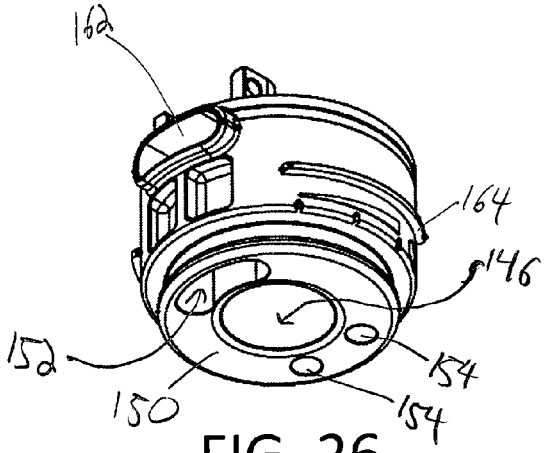
FIG. 26 is a perspective view of a lid body lower portion of a flow control device according to certain example embodiments.
Figure 27:
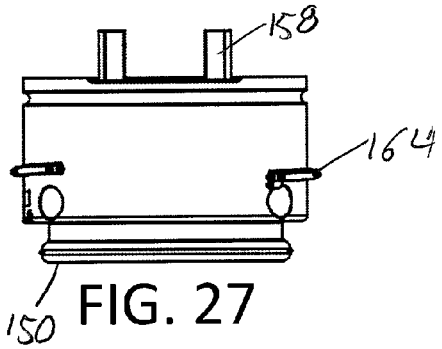
FIG. 27 is a side view of a lid body lower portion of a flow control device according to certain example embodiments.
Figure 28:
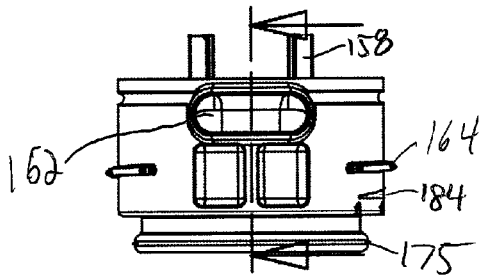
FIG. 28 is a side view of a lid body lower portion of a flow control device according to certain example embodiments.
Figure 29:
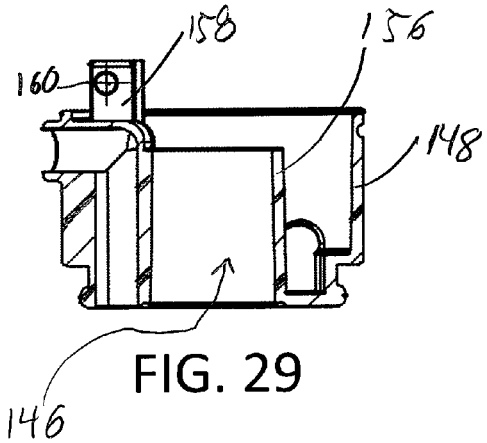
FIG. 29 is a side cross sectional view along the line indicated in FIG. 28.
Figure 30:
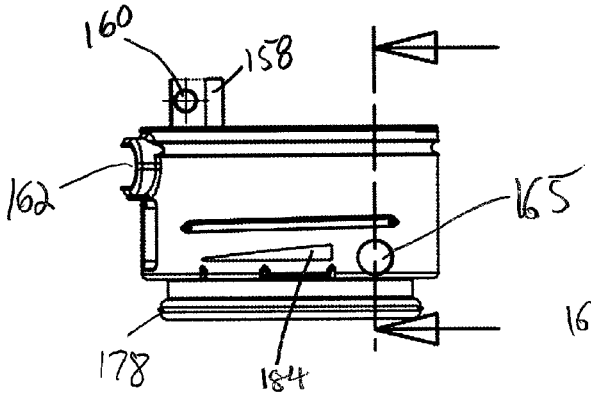
FIG. 30 is a side view of a lid body lower portion of a flow control device according to certain example embodiments.
Figure 31:
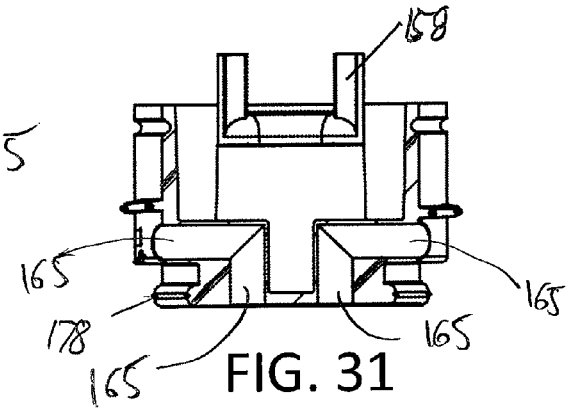
FIG. 31 is a side cross sectional view along the line indicated in FIG. 30.
Figure 32:
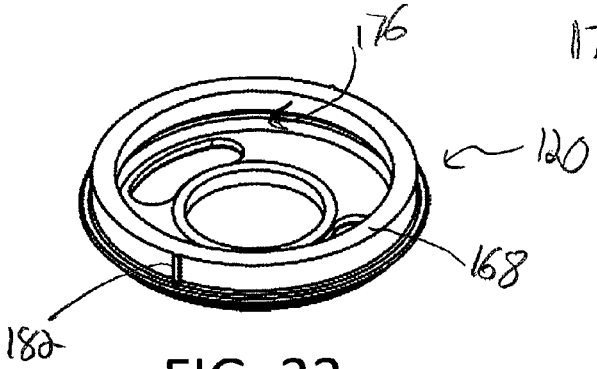
FIG. 32 is a perspective view of a sealing gasket of a flow control device according to certain example embodiments.
Figure 33:
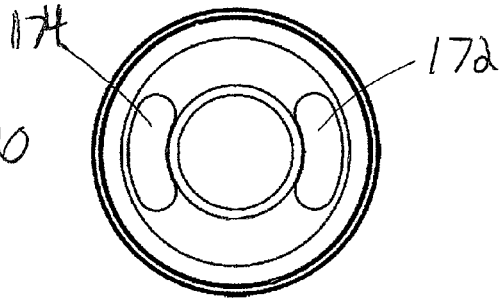
FIG. 33 is a top view of a sealing gasket of a flow control device according to certain example embodiments.
Figure 34:
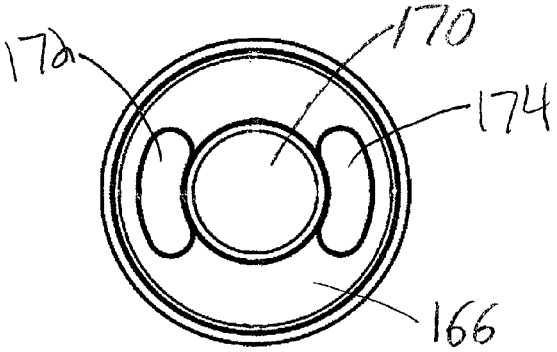
FIG. 34 is a bottom view of a sealing gasket of a flow control device according to certain example embodiments.
Figure 35:
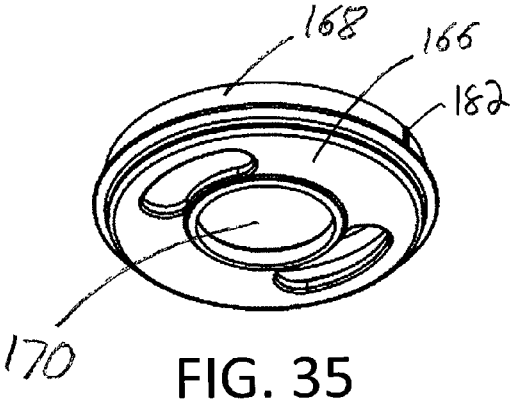
FIG. 35 is a perspective view of a sealing gasket of a flow control device according to certain example embodiments.
Figure 36:
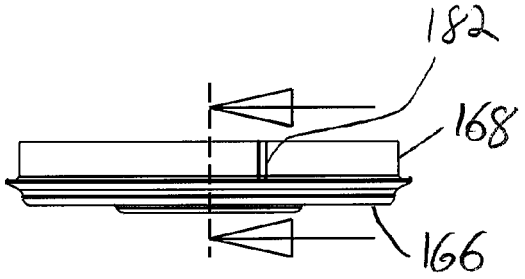
FIG. 36 is a side view of a sealing gasket of a flow control device according to certain example embodiments.
Figure 37:
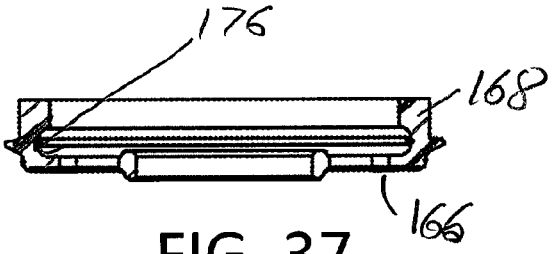
FIG. 37 is a side cross sectional view along the line indicated in FIG. 36.
Figure 38:
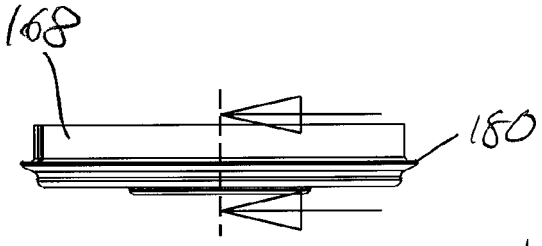
FIG. 38 is a side view of a sealing gasket of a flow control device according to certain example embodiments.
Figure 39:
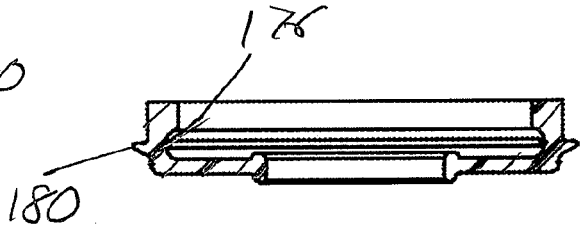
FIG. 39 is a side cross sectional view along the line indicated in FIG. 38.
Figure 40:
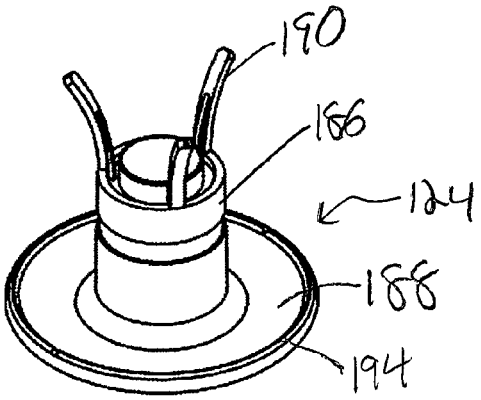
FIG. 40 is a perspective view of a plunger of a flow control device according to certain example embodiments.
Figure 41:
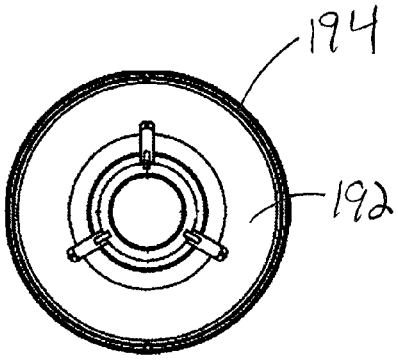
FIG. 41 is a top view of a plunger of a flow control device according to certain example embodiments.
Figure 42:
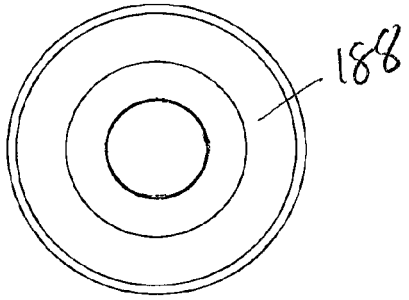
FIG. 42 is a bottom view of a plunger of a flow control device according to certain example embodiments.
Figure 43:
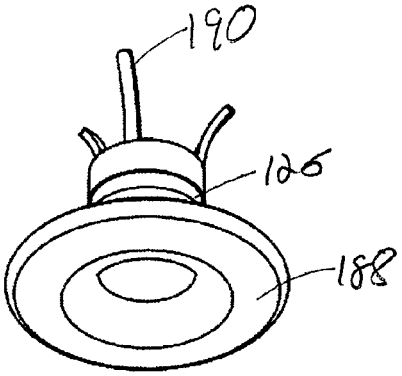
FIG. 43 is a perspective view of a plunger of a flow control device according to certain example embodiments.
Figure 44:
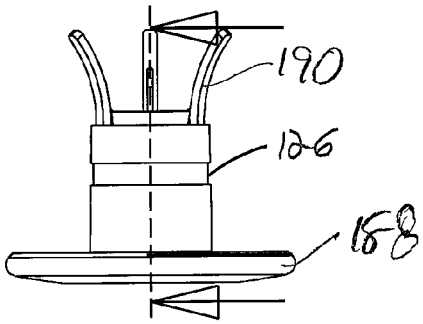
FIG. 44 is a side view of a plunger of a flow control device according to certain example embodiments.

Referring now to FIGS. 6-7, the cap 114 is shown in further detail. The cap is generally disc-shaped with a slightly convex upper surface 128 and a generally planar bottom surface 130. The lid can be formed of a different type and/or color material than the remainder of the lid assembly. This allows for the lid to be changed to a different color or bear an indicator of the contents of the particular dispenser. For example, a dispenser containing decaffeinated coffee may be provided with a lid that is tan while regular coffee would be black, stainless or some other color/material; milk could be a white cap, etc. The cap also prevents contaminants from entering the lid assembly if the lid upper body portion 116 has an open center such as that shown in FIGS. 8-16.

The lid body upper portion 116 is shown in greater detail in FIGS. 8-16. The upper portion is generally hoop shaped as defined by the circular sidewall 131 and open center. A bottom apron 132 extends downwardly to mate with the lower body portion 118. An aperture 134 is defined in the sidewall and is configured to receive the pivot end of the lever 110. An opposing recess 136 in the apron 132 provides clearance for the lever 110 to extend outwardly when the upper 116 and lower 118 portions are mated. The upper portion 116 can be formed of a rigid plastic or rubber material. The open top of the upper portion can also be formed with a solid surface, thus eliminating the need for a separate cap 114.

The lever 110 is shown in greater detail in FIGS. 17-22. The lever is a generally elongated body having a pivot end 138 and an actuating end 140. The pivot end 138 pivots about a horizontal axis in the pivot holder of the lower portion 116 when the actuating end 140 is pressed downwards by the user via a pair of pivot projections 139. The downward motion on the end 140 causes a downward protrusion or projection portion 142 to move downward and push the plunger 124 away from its seat on the gasket 120. The lever 110 also defines a partial apron 144 that is sized and shaped to fill the extents of the recess 136 in the apron 132 of the upper portion when the lid assembly 104 is in the closed state. A thumb rest 112 is defined on the actuating end 140 as mentioned previously. The length of the actuating end portion 140 is defined to provide a comfortable reach for the thumb of a user's hand while simultaneously gripping the handle 106. The lever 110 can be formed of a rigid plastic or rubber material.

The lid body lower portion 118 is shown in greater detail in FIGS. 23-31. The lower portion 118 is generally cup shaped with a plunger channel 146 defined in the center thereof. A circular outer wall 148 defines a generally hollow interior with an open top and a closed bottom 150. The bottom 150 defines a beverage flow aperture 152 and one or more vent channels 154. The plunger channel 146 is defined by an internal circular wall 156 extending upwardly from the bottom surface 150. A lever support 158 extends upwardly from the bottom surface and is located between the outer wall 148 and the inner wall 156. The lever support includes opposing pivot recesses 160 for receiving respective pivot projections of the lever body. A dispensing aperture 162 is defined in the outer wall 148 for communicating the beverage contents to the spout 108. The lower portion 118 can be formed of a rigid plastic or rubber material.

A plurality of thread projections 164 extend outwardly from the outer wall 148. The thread projections 164 are configured to mate with respective threads defined in a neck of the dispenser body 102 to removably secure the lid assembly 104 to the dispenser body 102. In one embodiment, the threads 164 are configured for ¼ turn securement.

One or more vent passages 165 are also defined in the lower portion 118 to communicate between the bottom surface that receives the gasket and with the outer wall 148. Thus, the passages prevent a vacuum from forming inside of the dispenser's interior when dispensing the beverage. Such vacuum conditions can cause intermittent flow and may promote spilling.

The gasket 120 is shown in greater detail in FIGS. 32-39. The gasket generally resembles a circular disc and defines a generally planar bottom surface 166 with a circular wall 168 extending upwardly therefrom. A central aperture 170 is defined in the bottom surface 166 to align in shape and location with the plunger channel in the lower portion 118. The bottom surface further includes a beverage flow aperture 172 and a vent aperture 174. The flow aperture can be aligned with the beverage flow aperture 152 of the lower portion 118 to allow a selected beverage flow volume. The vent aperture is sized and located on the bottom surface to align with the one or more vent passages in the lower portion when the gasket is rotationally aligned for a given flow volume as will be described later herein.

The gasket 120 further defines a retention channel 176 formed internally adjacent the intersection of the circular wall 168 and bottom surface 166. The channel 176 is sized and located to receive a respective outwardly projecting circular flange 178 defined adjacent the bottom of the lower portion 118.

An additional exterior flange 180 extends outwardly from the sidewall (or adjacent the bottom surface) of the wall 168. The exterior flange 180 extends outward a sufficient distance to contact the inside surface in the opening of the neck of the dispenser body. This contact forms a fluidic seal between by the lid assembly to prevent liquid from escaping the dispenser except through the dispensing channel when the lever 110 is actuated to allow such dispensing.

The gasket further includes flow rate indicator 182 defined on the outside of the side wall 168. Also, flow rate markings 184 are disposed on the outside surface of the outer sidewall 148 of the lower portion 118. The flow rate marking can be presented as a gauge like that show in the figures that indicates both a maximum flow alignment position and a minimum flow alignment position.

The respective indicators and markings 182 and 184 allow the user to rotationally align the indicator 182 with the flow rate markings to achieve a desired flow rate of beverage dispensing. The flow rate can be changed by removing and re-installing the gasket, or by rotating the gasket until the indicator 182 aligns with the desired flow rate setting indicated by the markings 184. This feature will be described further herein below.

The gasket is preferably formed of a resilient rubber or silicone material to maintain shape and provide good sealing characteristics. The gasket performs multiple simultaneous functions, including sealing the open top of the container, sealing the bottom surface of the lower body and defining the dispensing flow rate. Also, the seal can be easily removed and replaced if it becomes damaged or worn. This feature reduces replacement parts cost, extends useful life of the dispenser device and improves cleanability.

The seal ring 122 is configured and sized to be secured in the groove in the sidewall of the plunger 124. The seal ring includes an outwardly extending sealing surface as can be seen in FIG. 4. The sealing surface seals the gap between the plunger body and the inner wall 156 defining the plunger channel 146 of the lower body portion 118. The seal ring 122 thus prevents contents of the dispenser from entering the lid assembly through the plunger channel 146. Thus, leaks do not occur and the lever is not fouled with the beverage contents. Also, contaminants cannot reach the contents of the dispenser.

Figure 45:
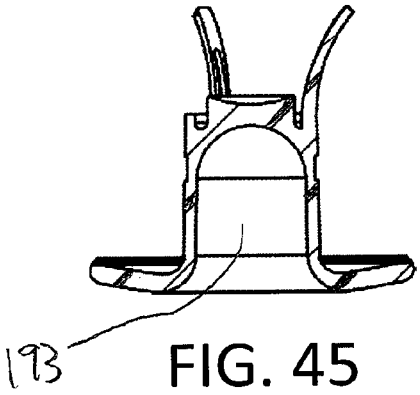
FIG. 45 is a side cross sectional view along the line indicated in FIG. 44.

The plunger 124 is shown in greater detail in FIGS. 40-45. The plunger comprises a cylindrical body 186 disposed on a planar disk base or portion 188 at one end. A plurality of resilient finger portions 190 extend axially and radially outwardly from the opposing end of the cylindrical body. The fingers 190 can be curved to accomplish such extension as shown in the drawings. A cam surface defined at the end of the cylindrical body opposite the disk 188 is either flat or slightly concave in order to be contacted by the projection portion 142 of the lever 110. The disk portion 188 defines an upwardly facing sealing surface 192 that can also be slightly concave as best seen in FIG. 45. The plunger can be unitarily formed of a rigid plastic or rubber material. An interior portion 193 of the cylinder can be hollow to reduce material cost and weight.

The outer edge 194 of the sealing surface contacts the bottom surface 166 of the gasket 120 to form a fluid tight seal. The resilient fingers 190 extend upwards into the plunger channel 146 and spread outwardly beyond the end of the channel 146 inside of the lower body portion 118. This arrangement retains the plunger in the sealed position against the gasket until the lever 110 is pressed to push the plunger downwards to retract from contact with the gasket. Thus beverage is allowed to flow outwards through the dispensing channel.

In use, the components of the lid assembly are assembled as indicated in FIGS. 4-5. The rotational alignment of the gasket 120 with respect to the lower body portion 118 can be set to define a maximum dispensing flow rate as will be described in more detail with respect to FIGS. 46-51.

Figure 46:
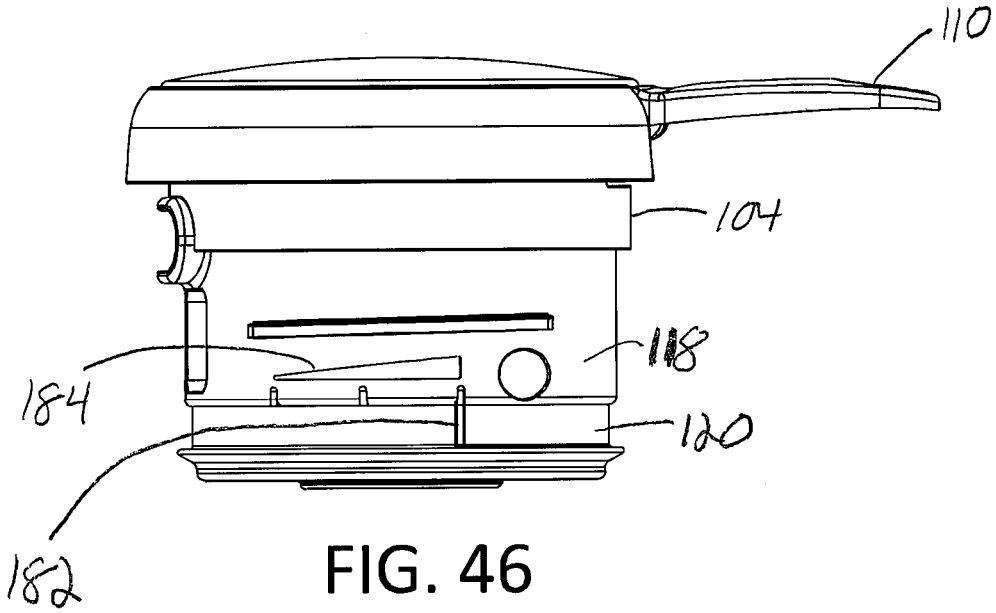
FIG. 46 is a side view of a flow control device in a maximum flow configuration according to certain example embodiments.
Figure 47:
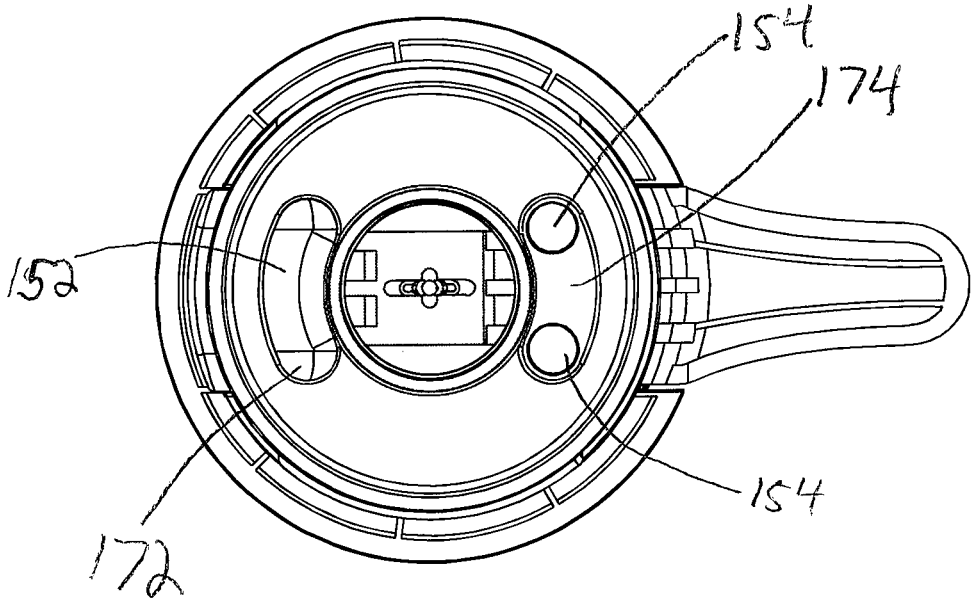
FIG. 47 is a bottom view of a flow control device in a maximum flow configuration according to certain example embodiments.

Referring to FIGS. 46-47, the lid assembly 104 indicates that the gasket 120 is aligned for a maximum flow rate. The indicator 182 on the gasket is disposed adjacent to the fattest portion of the flow rate marking 184 on the lower body portion 118. The tapered shape of the marking 184 is a visual indicator to the user of the relative minimum to maximum flow rate range of gasket alignments. Aligning the gasket in the maximum flow position corresponds with the flow aperture 172 of the gasket blocking no portion of the inlet to the beverage flow aperture 152. Also, the vent aperture 174 in this alignment blocks no portion of either vent channel 154. Thus maximum flow and venting can be permitted when the user depresses the lever 110.

Figure 48:
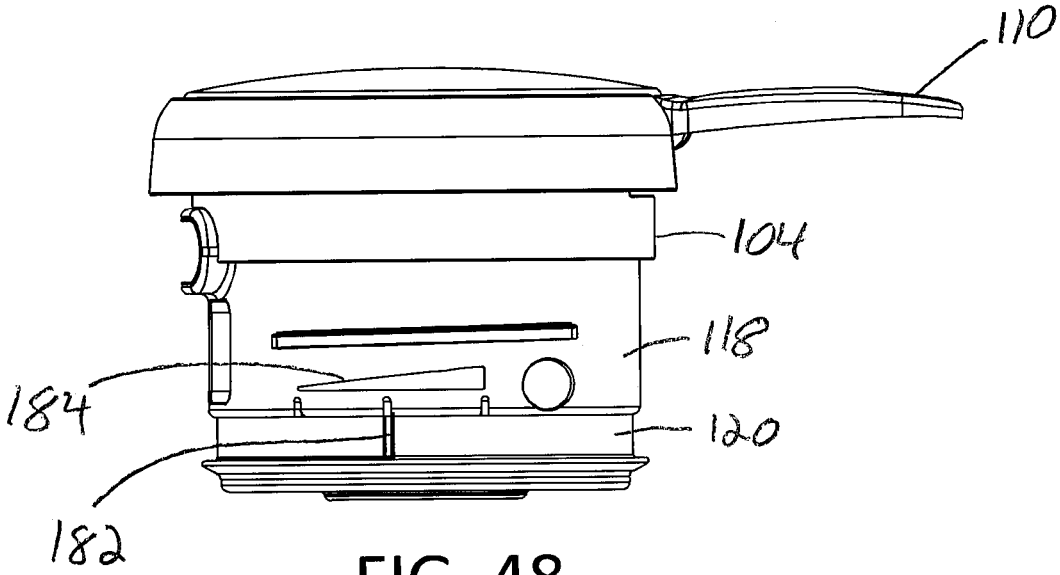
FIG. 48 is a side view of a flow control device in an intermediate flow configuration according to certain example embodiments.
Figure 49:
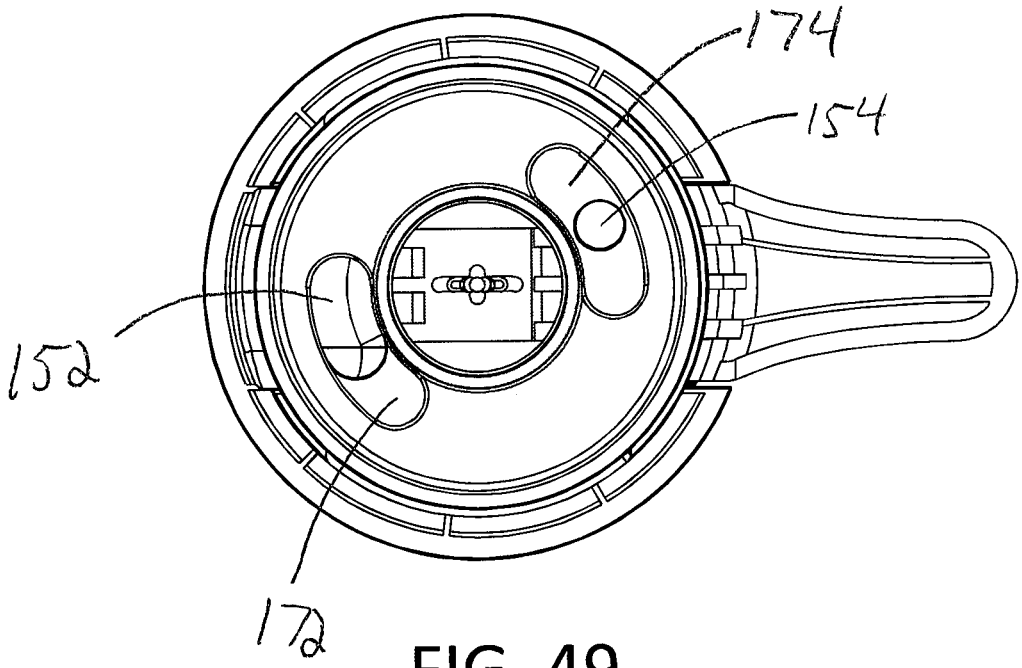
FIG. 49 is a bottom view of a flow control device in an intermediate flow configuration according to certain example embodiments.

Referring next to FIGS. 48-49, an intermediate flow rate alignment is illustrated. Here the indicator 182 on the gasket is disposed adjacent to the approximate middle of the flow rate marking 184 on the lower body portion 118. This approximate middle rate position corresponds with the flow aperture 172 of the gasket blocking approximately half of the inlet to the beverage flow aperture 152. Also, the vent aperture 174 in this alignment blocks one of the two vent channels 154. Thus intermediate flow and venting can be permitted when the user depresses the lever 110. It should be noted that the flow rate can be set at any position between the maximum and minimum positions, not just the middle intermediate position shown and described herein.

Figure 50:
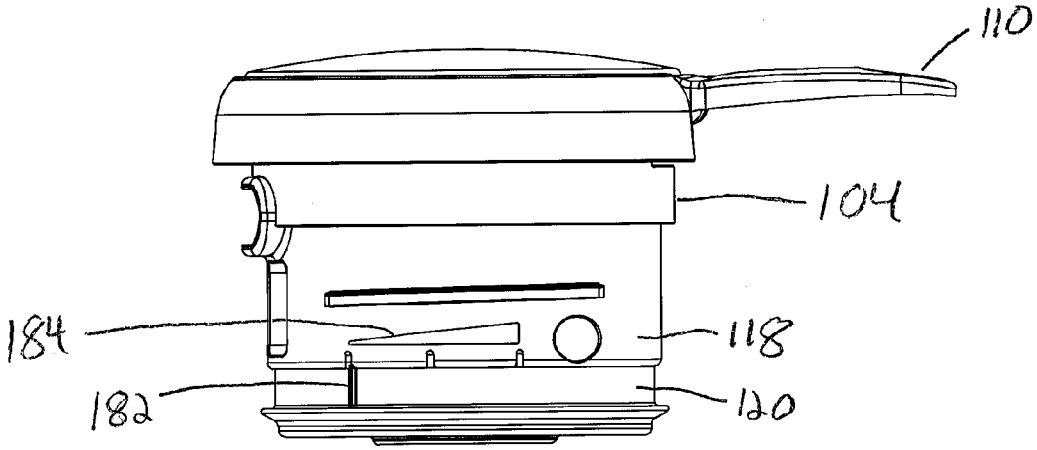
FIG. 50 is a side view of a flow control device in a minimum flow configuration according to certain example embodiments.
Figure 51:
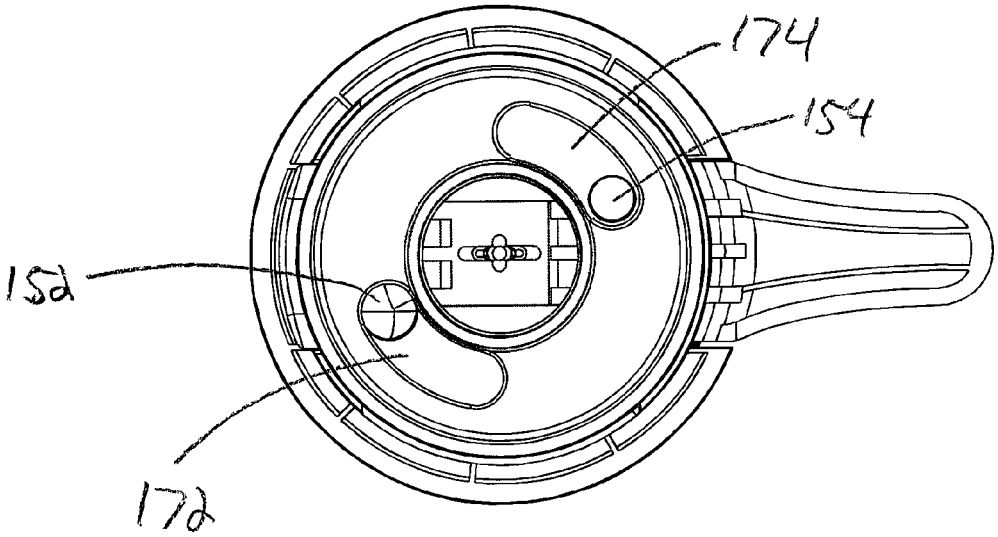
FIG. 51 is a bottom view of a flow control device in a minimum flow configuration according to certain example embodiments.

Referring now to FIGS. 50-51, a minimum flow rate alignment is illustrated. Here the indicator 182 on the gasket is disposed adjacent to the smallest end of the flow rate marking 184 on the lower body portion 118. This minimum rate position corresponds with the flow aperture 172 of the gasket blocking most (e.g. 75%) of the inlet to the beverage flow aperture 152. Also, the vent aperture 174 in this alignment leaves one of the two vent channels 154 unblocked so that there is adequate venting. Thus minimum flow can be permitted when the user depresses the lever 110.

It should be noted that the apertures 172 and 174 can be configured in additional embodiments to permit alignment such that anywhere between 0% and 100% flow rate can be set by rotational alignment of the gasket 120 with respect to the lower body portion 118.

While the invention has been described in connection with what is presently considered to be the most practical and preferred embodiments, it will be apparent to those of ordinary skill in the art that the invention is not to be limited to the disclosed embodiments. It will be readily apparent to those of ordinary skill in the art that many modifications and equivalent arrangements can be made thereof without departing from the spirit and scope of the present disclosure, such scope to be accorded the broadest interpretation of the appended claims so as to encompass all equivalent structures and products. Moreover, features or aspects of various example embodiments may be mixed and matched (even if such combination is not explicitly described herein) without departing from the scope of the invention.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. A liquid beverage dispenser comprising:

a receptacle having a hollow interior space and an open top to access the interior space; and a dispensing lid assembly comprising a lid body upper portion;

a lid body lower portion connected to the lid body upper portion, the lid body lower portion defining a flow aperture in a bottom surface thereof and a vent channel in a portion thereof;

an actuation lever extending outwardly from the connected upper portion and lower portion;

a sealing gasket disposed on a bottom portion of the lid body lower portion, the sealing gasket comprising a generally planar bottom surface and a circular wall extending upwardly therefrom, the bottom surface including a beverage flow aperture and a vent aperture defined therein, the beverage flow aperture and the vent aperture configured to define a maximum flow position when the sealing gasket is rotationally aligned with respect to the lid body lower portion such that the beverage flow aperture of the gasket does not block the flow aperture of the lid body lower portion and to define a minimum flow position when the sealing gasket is rotationally aligned with respect to the lid body lower portion such that the beverage flow aperture of the gasket blocks at least the majority of the flow aperture of the lid body lower portion while leaving at least a portion of the vent channel unblocked; and a movable plunger in operable communication with the actuation lever, the plunger including a sealing disk contacting the bottom surface of the gasket when the plunger is in a retracted state to form a fluid tight seal such that the beverage flow aperture and the vent aperture are blocked.

2. The liquid beverage dispenser of claim 1, wherein the sealing gasket further includes an exterior flange extending outwardly from the sidewall such that the flange contacts the an inside surface of the open top of the receptacle to form a fluid-tight seal between by the lid assembly and the receptacle.

3. The liquid beverage dispenser of claim 1, wherein the sealing gasket includes flow rate indicator defined on an outside surface of the side wall and wherein a flow rate marking is disposed on an outside surface of the lid body lower portion.

4. The liquid beverage dispenser of claim 3, wherein the flow rate marking is a gauge indicating both a maximum flow alignment position and a minimum flow alignment position.

5. The liquid beverage dispenser of claim 1, wherein the plunger includes a top cam surface and the lever includes a lower projection configured to contact the plunger top cam surface when the plunger is pressed by a user.

6. The liquid beverage dispenser of claim 5, wherein the plunger further includes a plurality of resilient fingers extending upwards into the lid body lower portion to retain the plunger in a sealed position against the bottom surface of the sealing gasket unless the lower projection of the lever contacts the plunger top cam surface to retract the plunger away from the sealed position.

7. The liquid beverage dispenser of claim 1, further comprising a plurality of quarter turn threads projecting outwardly of the lid body lower portion.

8. A method of dispensing beverages from a beverage dispenser, the method comprising:

disposing a sealing gasket on a lower portion of a lid assembly body while rotationally aligning an indicator on the gasket with a flow rate marking on the lid assembly body, the alignment step blocking none of a beverage dispensing passage in the lid assembly body with a gasket bottom surface in a maximum flow state and the alignment step blocking a majority of a beverage dispensing passage in the lid assembly body with the gasket bottom surface in a minimum flow state; and contacting a sealing disk of a plunger against a bottom surface of the sealing gasket when the plunger is in a retracted state to block all beverage flow through the beverage dispensing passage.

9. The method of claim 8, further including securing the gasket to the lid assembly body so that it does not rotate with respect to the lid assembly body when disposed thereon.

10. The method of claim 8, wherein the step of disposing the gasket includes rotationally aligning the gasket with the lid assembly body in an intermediate position between the maximum flow state and the minimum flow state.

11. The method of claim 8, further comprising forming a seal between the lid assembly and an open top of the beverage dispenser by contacting an inside surface of the open top with an exterior flange extending outwardly from a sidewall of the gasket.

12. The method of claim 8, further comprising pressing downward on a dispensing lever to retract the sealing disk from contacting the gasket bottom surface.

13. The method of claim 12, further comprising pushing downward on the dispensing lever to move the sealing disk away from contacting the gasket bottom surface.

14. A beverage dispensing flow control device, comprising:

a body portion including an outer sidewall surface and a bottom surface, a flow aperture defined in the bottom surface and a vent channel defined therethrough and in communication with the bottom surface and the outer sidewall surface;

an actuation lever extending outwardly from the body portion;

a sealing gasket securable over the bottom surface of the body portion, the sealing gasket comprising a generally planar bottom surface and a circular wall extending upwardly therefrom, the circular wall configured to contact the outer sidewall surface of the body portion, the bottom surface including a beverage flow aperture and a vent aperture defined therein, the beverage flow aperture and the vent aperture configured to define a maximum flow position when the sealing gasket is rotationally aligned with respect to the body portion such that the beverage flow aperture of the gasket does not block the flow aperture of the body portion and to define a minimum flow position when the sealing gasket is rotationally aligned with respect to the body portion such that the beverage flow aperture of the gasket blocks at least the majority of the flow aperture of the body portion while leaving at least a portion of the vent channel unblocked where it communicates with the bottom surface of the body portion; and a movable plunger in operable communication with the actuation lever, the plunger including a sealing disk portion disposed opposite the top cam surface, the sealing disk selectively contacting the bottom surface of the gasket to form a fluid tight seal such that the beverage flow aperture and the vent aperture are blocked.

15. The beverage dispensing flow control device of claim 14, wherein the sealing gasket further includes an exterior flange extending outwardly from the sidewall.

16. The beverage dispensing flow control device of claim 14, wherein the sealing gasket includes flow rate indicator defined on an outside surface of the side wall and wherein a flow rate marking is disposed on the outer sidewall surface of the body portion, the flow rate marking indicating both a maximum flow alignment position and a minimum flow alignment position.

17. The beverage dispensing flow control device of claim 14, wherein the plunger includes a top cam surface and the lever includes a lower projection configured to contact the plunger top cam surface when the plunger lever is pressed by a user.

* * * * *